US008072386B2

(12) United States Patent
Lier et al.

(10) Patent No.: US 8,072,386 B2
(45) **Date of Patent: *Dec. 6, 2011**

(54) HORN ANTENNA, WAVEGUIDE OR APPARATUS INCLUDING LOW INDEX DIELECTRIC MATERIAL

(75) Inventors: Erik Lier, Newtown, PA (US); Allen Katz, West Windsor, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 412 days.

This patent is subject to a terminal disclaimer.

(21) Appl. No.: 12/245,497

(22) Filed: Oct. 3, 2008

(65) Prior Publication Data

US 2009/0284429 A1 Nov. 19, 2009

Related U.S. Application Data

(63) Continuation-in-part of application No. 12/037,013, filed on Feb. 25, 2008, now Pat. No. 7,629,937.

(51) Int. Cl.
*H01Q 13/00* (2006.01)

(52) U.S. Cl. ..... 343/786; 343/772

(58) Field of Classification Search ..... 343/786, 343/771, 772, 756, 909, 700 MS
See application file for complete search history.

(56) References Cited

U.S. PATENT DOCUMENTS

| | | | | |
|---|---|---|---|---|
| 4,246,584 | A | 1/1981 | Noerpel | |
| 4,447,811 | A | 5/1984 | Hamid | |
| 5,041,840 | A | 8/1991 | Cipolla et al. | |
| 5,214,394 | A | 5/1993 | Wong | |
| 5,214,398 | A | 5/1993 | Wong | |
| 6,879,297 | B2 | 4/2005 | Brown et al. | |
| 6,985,118 | B2 * | 1/2006 | Zarro et al. | 343/756 |
| 6,992,639 | B1 | 1/2006 | Lier | |
| 7,193,578 | B1 | 3/2007 | Harris et al. | |
| 7,379,030 | B1 | 5/2008 | Lier | |
| 7,629,937 | B2 * | 12/2009 | Lier et al. | 343/786 |
| 2001/0020920 | A1 | 9/2001 | Shigihara | |
| 2003/0210197 | A1 | 11/2003 | Cencich et al. | |
| 2005/0007289 | A1 | 1/2005 | Zarro et al. | |
| 2005/0083241 | A1 | 4/2005 | Zarro et al. | |
| 2005/0107125 | A1 | 5/2005 | Gilbert | |

(Continued)

FOREIGN PATENT DOCUMENTS

| | | |
|---|---|---|
| WO | WO 91/15879 | 10/1991 |

OTHER PUBLICATIONS

Lier et al., "A New Class of Dielectric-Loaded Hybrid-Mode Horn Antennas with Selective Gain: Design and Analysis by Single Mode Model and Method of Moments," Jan. 2005, pp. 125-138, vol. 53, No. 1, IEEE Transactions on Antennas and Propagation.

(Continued)

*Primary Examiner* — Hoang V Nguyen
(74) *Attorney, Agent, or Firm* — McDermott Will & Emery LLP

(57) ABSTRACT

A horn antenna includes a conducting horn having an inner wall and a first dielectric layer lining the inner wall of the conducting horn. The first dielectric layer includes a metamaterial having a relative dielectric constant of greater than 0 and less than 1. The horn antenna may further include a dielectric core abutting at least a portion of the first dielectric layer. In one aspect, the dielectric core includes a fluid. A waveguide including a metamaterial is also disclosed.

25 Claims, 8 Drawing Sheets

U.S. PATENT DOCUMENTS

2006/0092080 A1 5/2006 Lee

OTHER PUBLICATIONS

Lovat G., et al., "Combinations Of Low-High Permittivity And/Or Permeability Substrates For Highly Directive Planar Metamaterial Antennas, " Special Issue On Metamaterials EBG, IET Microw, Antennas Propag., Feb. 5, 2007, pp. 177-183.

Ziolkowski, "Metamaterials-Based Antennas: Research And Developments," IEICE Trans. Electron., Sep. 2006, pp. 1267-1275, vol. E89-C, No. 9.

Alu, et al., "Single-Negative, Double-Negative, And Low-Index Metamaterials And Their Electromagnetic Applications," IEEE Antennas And Propagations Magazine, Feb. 2007, pp. 23-36, vol. 49, No. 1.

* cited by examiner

HORN ANTENNA, WAVEGUIDE OR APPARATUS INCLUDING LOW INDEX DIELECTRIC MATERIAL

CROSS-REFERENCE TO RELATED APPLICATION

This is a continuation-in-part of U.S. patent application Ser. No. 12/037,013 entitled "HORN ANTENNA, WAVEGUIDE OR APPARATUS INCLUDING LOW INDEX DIELECTRIC MATERIAL," filed on Feb. 25, 2008 now U.S. Pat. No. 7,629,937, which is hereby incorporated by reference in its entirety for all purposes.

FIELD

The present invention generally relates to antennas and communication devices, and in particular, relates to horn antennas, waveguides and apparatus including low index dielectric material.

BACKGROUND

Maximum directivity from a horn antenna may be obtained by uniform amplitude and phase distribution over the horn aperture. Such horns are denoted as "hard" horns.

Exemplary hard horns may include one having longitudinal conducting strips on a dielectric wall lining, and the other having longitudinal corrugations filled with dielectric material. These horns work for various aperture sizes, and have increasing aperture efficiency for increasing size as the power in the wall area relative to the total power decreases.

Dual mode and multimode horns like the Box horn can also provide high aperture efficiency, but they have a relatively narrow bandwidth, in particular for circular polarization. Higher than 100% aperture efficiency relative to the physical aperture may be achieved for endfire horns. However, these endfire horns also have a small intrinsic bandwidth and may be less mechanically robust.

Linearly polarized horn antennas may exist with high aperture efficiency at the design frequency, large bandwidth and low cross-polarization. However, these as well as the other non hybrid-mode horns only work for limited aperture size, typically under 1.5 or 2λ.

A horn antenna may be also configured as a "soft" horn with a $J_1(x)/x$-type aperture distribution, corresponding to low gain and low sidelobes, and having a maximum bandwidth. Exemplary soft horns may include one having corrugations or strips on dielectric wall liners where these corrugations or strips are transverse to the electromagnetic field propagation direction.

SUMMARY

The present invention provides a new class of hybrid-mode horn antennas. The present invention facilitates the design of boundary conditions between soft and hard, supporting modes under balanced hybrid condition with uniform as well as tapered aperture distribution. According to one aspect of the disclosure, hybrid-mode horn antennas of the present invention include a low index dielectric material such as a metamaterial having a relative dielectric constant of greater than zero and less than one. The use of such metamaterial allows the core of the hybrid-mode horn antennas to comprise a fluid dielectric, rather than a solid dielectric, as is traditionally used.

In accordance with one aspect of the present invention, a horn antenna comprises a conducting horn having an inner wall and a first dielectric layer lining the inner wall of the conducting horn. The first dielectric layer comprises a metamaterial having a relative dielectric constant of greater than 0 and less than 1.

According to another aspect of the present invention, a waveguide comprises an outer surface defining a waveguide cavity, an inner surface positioned within the waveguide cavity, and a first dielectric layer lining the inner surface of the waveguide cavity. The first dielectric layer comprises a metamaterial having a relative dielectric constant of greater than 0 and less than 1.

Additional features and advantages of the invention will be set forth in the description below, and in part will be apparent from the description, or may be learned by practice of the invention. The objectives and other advantages of the invention will be realized and attained by the structure particularly pointed out in the written description and claims hereof as well as the appended drawings.

It may be understood that both the foregoing general description and the following detailed description are exemplary and explanatory and are intended to provide further explanation of the invention as claimed.

BRIEF DESCRIPTION OF THE DRAWINGS

Various aspects of a system of the present invention are illustrated by way of example, and not by way of limitation, in the accompanying drawings, wherein.

DETAILED DESCRIPTION

Figure 1:
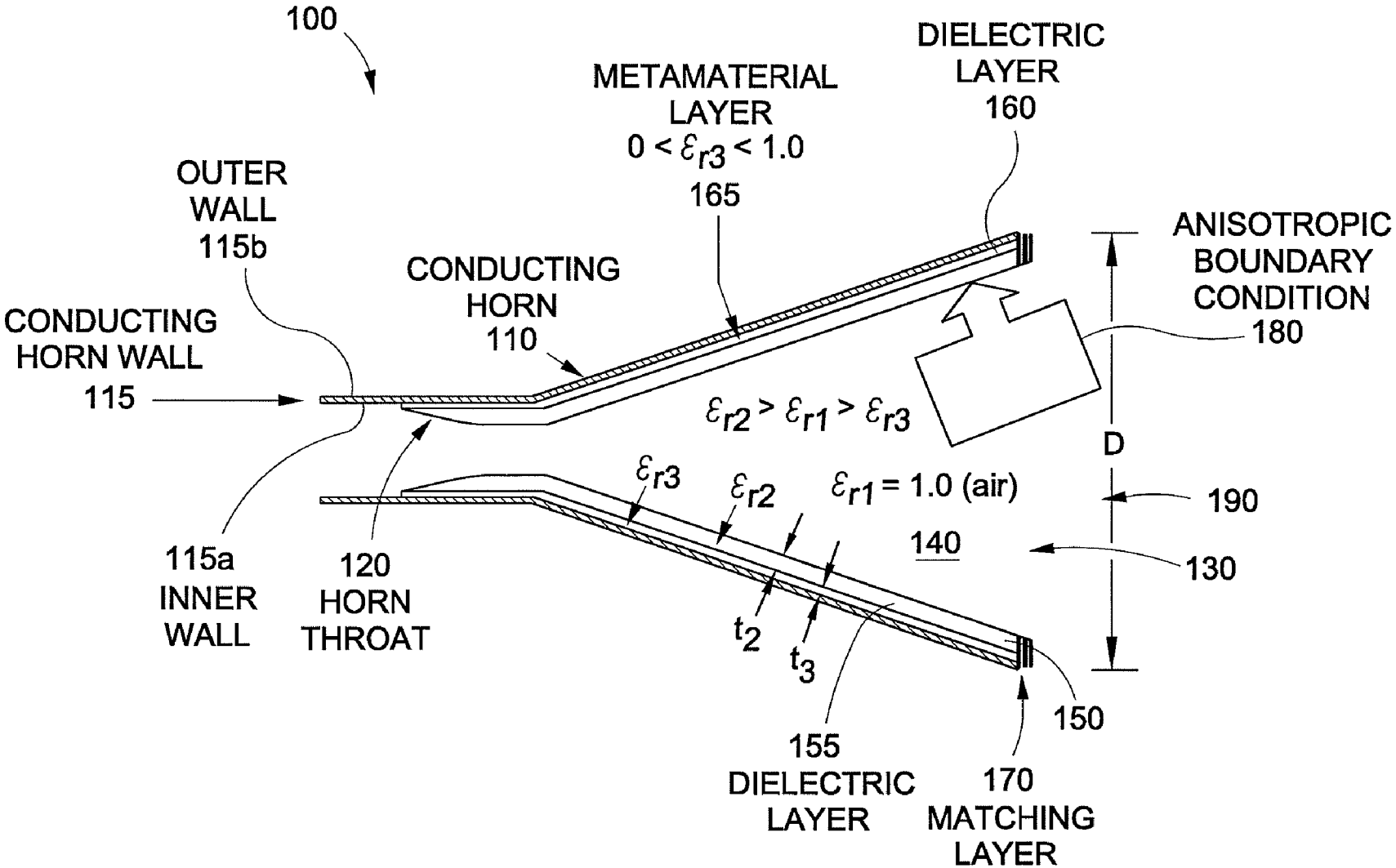
FIG. 1 illustrates an exemplary horn antenna in accordance with one aspect of the present invention.

In the following detailed description, numerous specific details are set forth to provide a full understanding of the present invention. It will be obvious, however, to one ordinarily skilled in the art that the present invention may be practiced without some of these specific details. In other instances, well-known structures and techniques have not been shown in detail to avoid obscuring concepts of the present invention.

Reference will now be made in detail to aspects of the subject technology, examples of which are illustrated in the accompanying drawings, wherein like reference numerals refer to like elements throughout.

In one aspect, a new and mechanically simple dielectric-loaded hybrid-mode horn is presented. As an example, a dielectric-loaded horn includes a horn that has a dielectric material disposed within the horn. In alternative aspects of the present invention, the horn satisfies hard boundary conditions, soft boundary conditions, or boundaries between soft and hard under balanced hybrid conditions. Like other hybrid-mode horns, the present design is not limited in aperture size.

For example, in one aspect of the present invention, the horns can support the transverse electromagnetic (TEM) mode, and apply to linear as well as circular polarization. They are characterized with hard boundary impedances:

$$Z_z=-E_z/H_x=0 \text{ and } Z_x=E_x/H_z=\infty \quad (1)$$

or soft boundary impedances:

$$Z_z=-E_z/H_x=\infty \text{ and } Z_x=E_x/H_z=0 \quad (2)$$

meeting the balanced hybrid condition:

$$Z_zZ_x=\eta_0^2 \quad (3)$$

where $\eta_0$ is the free space wave impedance and the coordinates z and x are defined as longitudinal with and transverse to the direction of the wave, respectively. In one aspect, both hard and soft horns may be constructed which satisfy the balanced hybrid condition (3), which provides a radiation pattern with low cross-polarization. Further, both hard and soft horns presented provide simultaneous dual polarization, i.e., dual linear or dual circular polarization.

The present horns may be used in the cluster feed for multibeam reflector antennas to reduce spillover loss across the reflector edge. Such horns may also be useful in single feed reflector antennas with size limitation, in quasi-optical amplifier arrays, and in limited scan array antennas.

FIG. 1 illustrates an exemplary horn antenna 100 in accordance with one aspect of the present invention. As shown in FIG. 1, horn antenna 100 represents a hard horn and includes a conducting horn 110 having a conducting horn wall 115. Conducting horn wall 115 may include an inner wall 115*a* and an outer wall 115*b*. Conducting horn wall 115 extends outwardly from a horn throat 120 to define an aperture 190 having a diameter D. While referred to as "diameter," it will be appreciated by those skilled in the art that conducting horn 110 may have a variety of shapes, and that inner wall 115*a*, outer wall 115*b*, and aperture 190 may be circular, elliptical, rectangular, hexagonal, square, or some other configuration all within the scope of the present invention. In one aspect, conducting horn 110 has anisotropic wall impedance according to equations (1) and (2) and shown by anisotropic boundary condition 180. Furthermore, anisotropic boundary condition 180 can be designed to meet the balanced hybrid condition in equation (3) in the range from hard to soft boundary conditions.

The space within horn 110 may be at least partially filled with a dielectric core 130. In one aspect, dielectric core 130 includes an inner core portion 140 and an outer core portion 150. In one aspect, inner core portion 140 comprises a fluid such as an inert gas, air, or the like. In some aspects, inner core portion 140 comprises a vacuum. In one aspect, outer core portion 150 comprises polystyrene, polyethylene, teflon, or the like. It will be appreciated by those skilled in the art that alternative materials may also be used within the scope of the present invention.

In this example, each of inner wall 115*a* and outer wall 115*b* is circular, and is one continuous wall completely surrounding inner core portion 140 (but not covering the two end apertures, i.e., the left of horn throat 120 and the right of aperture 190). Each of inner wall 115*a* and outer wall 115*b* is tapered in the tapered region such that its diameter at aperture 190 is larger than its respective diameter at horn throat 120. Each of inner wall 115*a* and outer wall 115*b* extends along the entire length of horn antenna 100.

In one aspect, dielectric core 130 may be separated from horn wall 115 by a first dielectric layer 160 which may help correctly position core 130. First dielectric layer 160 comprises a metamaterial and lines a portion or all of horn wall 115. In some aspects, first dielectric layer 160 comprises a metamaterial layer 165. In one example, first dielectric layer 160 is metamaterial layer 165.

Metamaterial layer 165 comprises a metamaterial having a low refractive index, i.e., between zero and one. Refractive index is usually given the symbol n:

$$n=\sqrt{(\epsilon_r\mu_r)} \quad (4)$$

where $\epsilon_r$ is the material's relative permittivity (or relative dielectric constant) and $\mu_r$ is its relative permeability. In one aspect of the disclosure, $\mu_r$ is very close to one, therefore n is approximately $\sqrt{\epsilon_r}$.

By definition a vacuum has a relative dielectric constant of one and most materials have a relative dielectric constant of greater than one. Some metamaterials have a negative refractive index, e.g., have a negative relative permittivity or a negative relative permeability and are known as single-negative (SNG) media. Additionally, some metamaterials have a positive refractive index but have a negative relative permittivity and a negative relative permeability; these metamaterials are known as double-negative (DNG) media. It may be generally understood that metamaterials possess artificial properties, e.g. not occurring in nature, such as negative refraction.

However, to date not much work has been done on metamaterials having a relative dielectric constant (relative permittivity) near zero. According to one aspect of the present invention, metamaterial layer 165 comprises a metamaterial having a relative dielectric constant of greater than zero and less than one. In some aspects, metamaterial layer 165 comprises a metamaterial having a permeability of approximately one. In these aspects, metamaterial layer 165 has a positive refractive index greater than zero and less than one.

In some aspects, outer core portion 150 comprises a second dielectric layer 155. In one example, outer core portion 150 is second dielectric layer 155. It may be understood that in one aspect, first dielectric layer 160, second dielectric layer 155 and inner core portion 140 have different relative dielectric constants. In some aspects, second dielectric layer 155 has a higher relative dielectric constant than does inner core portion 140 ($\epsilon_{r2}>\epsilon_{r1}$). In some aspects, inner core portion 140 has a higher relative dielectric constant than does first dielectric layer 160 ($\epsilon_{r1}>\epsilon_{r3}$). It should be appreciated that by using a metamaterial having a relative dielectric constant of greater than zero and less than one in first dielectric layer 160, inner core portion 140 may comprise a fluid such as air.

In one aspect, first dielectric layer 160 directly abuts inner wall 115*a*, second dielectric layer 155 directly abuts first dielectric layer 160, and inner core portion 140 directly abuts second dielectric layer 155. In this example, first dielectric layer 160 lines substantially the entire length of inner wall 115*a* (e.g., first dielectric layer 160 lines the entire length of horn antenna 100 in the tapered region and lines a majority of the length of horn antenna 100 in the straight region, or first dielectric layer 160 lines more than 60%, 70%, 80%, or 90% of the length of horn antenna 100). In this example, second dielectric layer 155 also lines substantially the entire length of inner wall 115*a*. The subject technology, however, is not limited to these examples.

In one aspect, first dielectric layer 160 has a generally uniform thickness $t_3$ and extends from about throat 120 to aperture 190. In one aspect, outer core portion 150 (or second dielectric layer 155) may have a generally uniform thickness $t_2$. As is known by those skilled in the art, $t_2$ and $t_3$ depend on the frequency of incoming signals. Therefore, both $t_2$ and $t_3$ may be constructed in accordance with thicknesses used generally for conducting horns. For example, in one aspect, thickness $t_2$ and/or $t_3$ may vary between horn throat 120 and aperture 190. In some aspects, one or both thickness $t_2$, $t_3$ may be greater near throat 120 than aperture 190, or may be less near throat 120 than aperture 190.

In one aspect, horn throat 120 may be matched for low return loss and for converting the incident field into a field with required cross-sectional distribution over aperture 190. This may be accomplished, for example, by the physical arrangement of inner core portion 140 and outer core portion 150. In this manner, the desired mode for conducting horn 110 may be excited.

Conducting horn 110 may further include one or more matching layers 170 between first dielectric layer 160, second dielectric layer 155 and free space in aperture 190. Matching layers 170 may be located at one end of first dielectric layer 160 and second dielectric layer 155, near aperture 190. Matching layers 170 may include, for example, one or more dielectric materials coupled to first dielectric layer 160, metamaterial layer 165, and/or outer core portion 150 near aperture 190. In one aspect, matching layer 170 has a relative dielectric constant between (i) the relative dielectric constant of air and (ii) first dielectric layer 160, metamaterial layer 165, and/or outer core portion 150 near aperture 190 to which it is coupled. In one aspect, matching layer 170 includes a plurality of spaced apart rings or holes. The spaced apart rings or holes (not shown) may have a variety of shapes and may be formed in symmetrical or non-symmetrical patterns. In one aspect, the holes may be formed in the aperture portion of core portions 140 and/or 150 to create a matching layer portion of core 130. In one aspect, the holes and/or rings may be formed to have depth of about one-quarter wavelength ($\frac{1}{4}\lambda$) of the effective dielectric material of the one-quarter wavelength transformer layer. In one aspect, outer portion 150 may include a corrugated matching layer (not shown) at aperture 190.

Conducting horn 110 of the present invention may have different cross-sections, including circular, elliptical, rectangular, hexagonal, square, or the like for circular or linear polarization. Referring to FIG. 7A, a hexagonal cross-section 700 is shown having an hexagonal aperture. In accordance with one aspect of the present invention, cross-section 700 includes a fluid dielectric core 720, a dielectric layer 730, another dielectric layer 740 (which is, for example, a metamaterial layer), and a conducting horn wall 710.

Figure 7B:
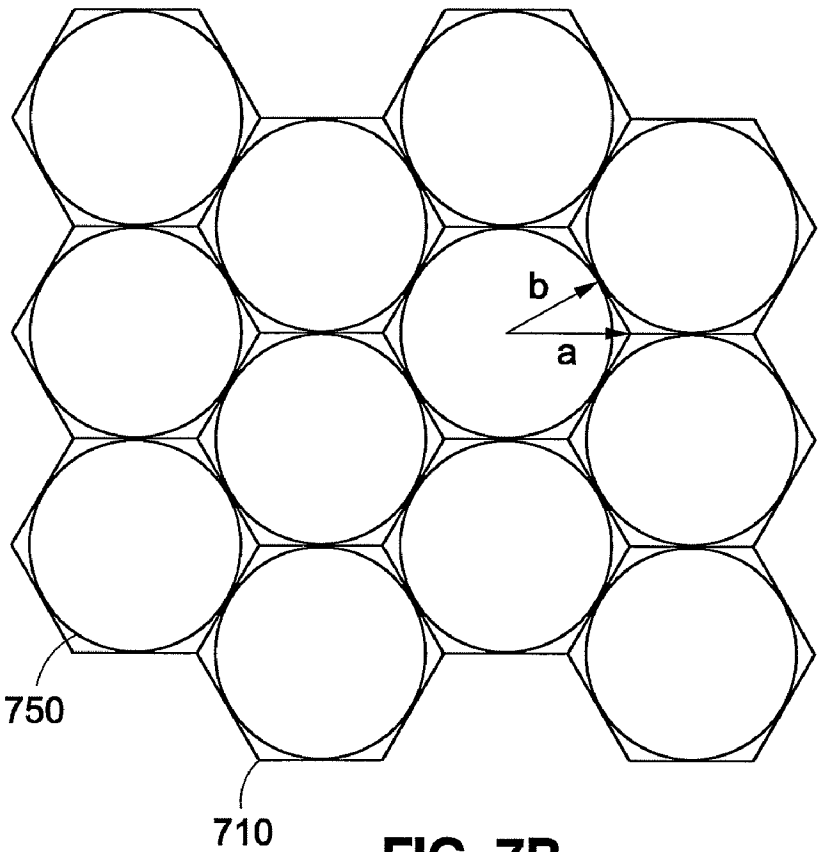
FIGS. 7A and 7B illustrate exemplary horn cross-sections for circular or linear polarization in accordance with one aspect of the present invention.
Figure 7A:
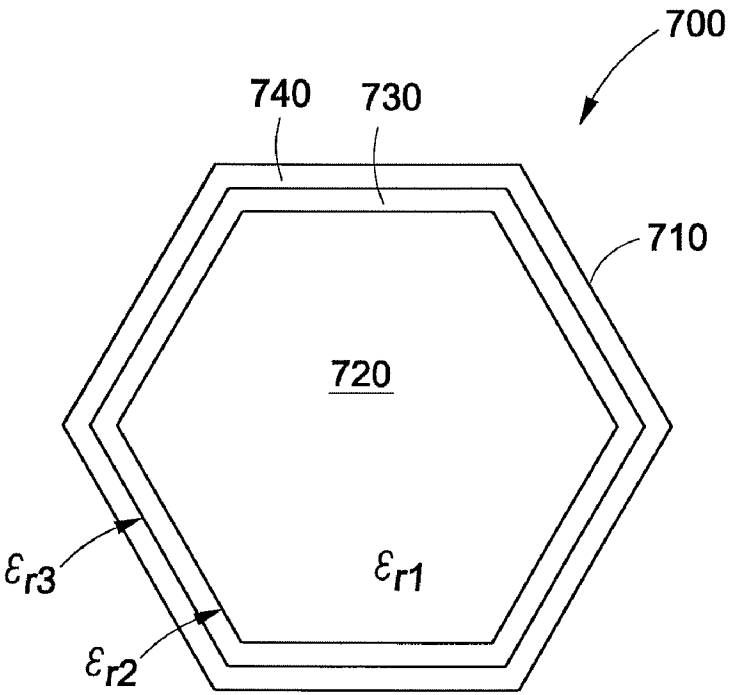

Referring briefly to FIG. 7B, a plurality of circular apertures 750 having a radii b are compared to a plurality of hexagonal apertures 710 having radii a. In this example, the area of a hexagonal aperture is about 10% larger than the area of a circular aperture; consequently a conducting horn 110 having a hexagonal aperture may have an array aperture efficiency of approximately 0.4 dB greater than a conducting horn 110 having a circular aperture.

Figure 2:
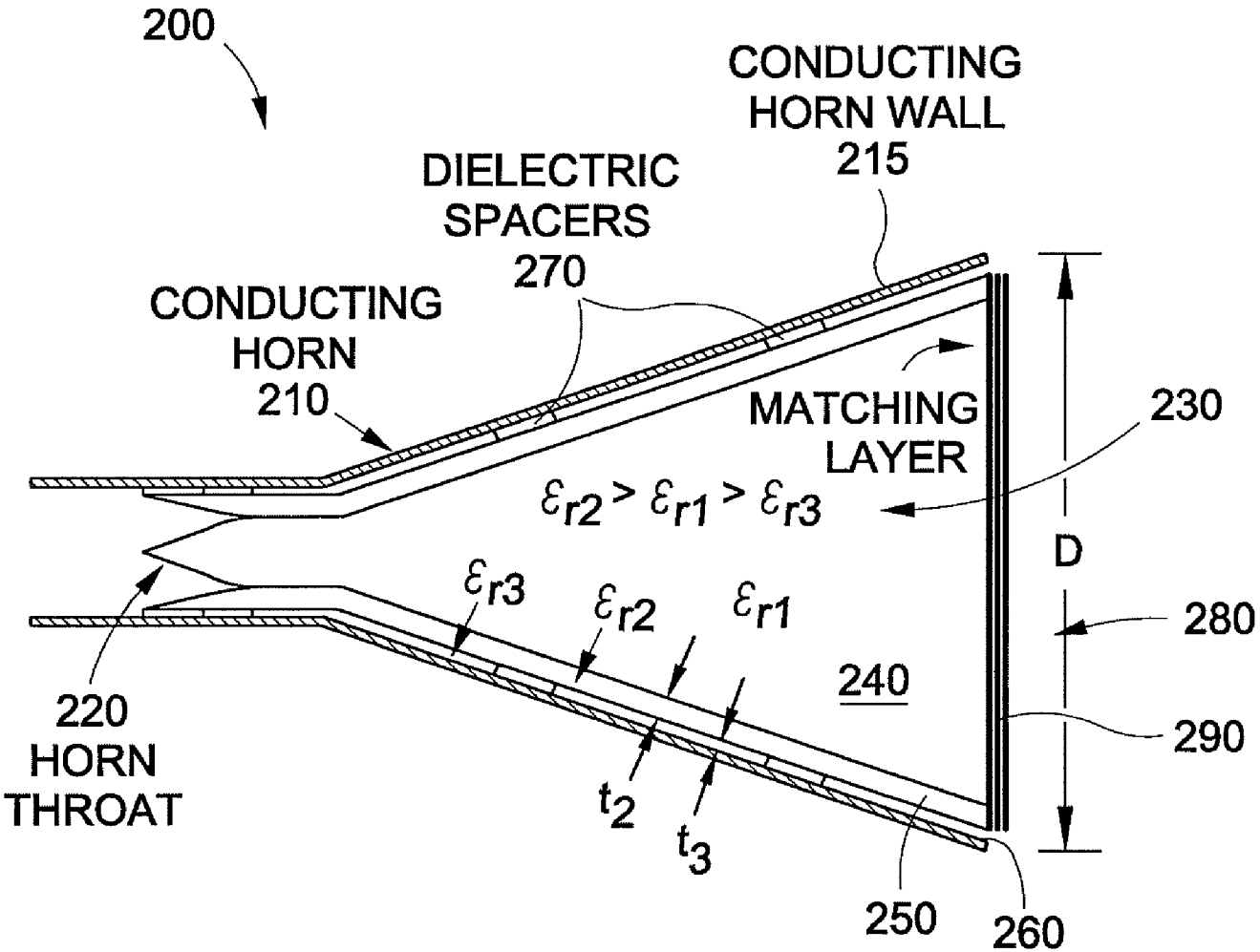
FIG. 2 illustrates another exemplary horn antenna.

Referring now to FIG. 2, an exemplary hard horn antenna 200 is illustrated. Horn antenna 200 includes a conducting horn 210 having a conducting horn wall 215. Conducting horn wall 215 extends outwardly from a horn throat 220 to define an aperture 280 having a diameter D.

The space within horn 210 may be at least partially filled with a dielectric core 230. In one aspect, dielectric core 230 includes an inner core portion 240 and an outer core portion 250. In one aspect, inner core portion 240 comprises a solid such as foam, honeycomb, or the like.

In one aspect, dielectric core 230 may be separated from wall 215 by a gap 260. In one aspect, gap 260 may be filled or at least partially filled with air. Alternatively, gap 260 may comprise a vacuum. In one aspect, a spacer or spacers 270 may be used to position dielectric core 230 away from horn wall 215. In some aspects, spacers 270 completely fill gap 260, defining a dielectric layer lining some or all of horn wall 215.

In one aspect, outer core portion 250 has a higher relative dielectric constant than does inner core portion 240. In one aspect, inner core portion 240 has a higher relative dielectric constant than does gap 260.

Gap 160 may have a generally uniform thickness $t_3$ and extends from about throat 220 to aperture 280. In one aspect, outer portion of core 250 has a generally uniform thickness $t_2$. As is known by those skilled in the art, $t_2$ and $t_3$ depend on the frequency of incoming signals. Therefore, both $t_2$ and $t_3$ may be constructed in accordance with thicknesses used generally for conducting horns.

Throat 220 of conducting horn 210 may be matched for low return loss and for converting the incident filed into a field with required cross-sectional distribution over aperture 280. Additionally, conducting horn 210 may include one or more matching layers 290 between dielectric and free space in aperture 280.

Dielectric-loaded horns constructed in accordance with aspects of the invention offer improved antenna performance, e.g., larger intrinsic bandwidth, compared to conventional antennas. Horn antennas constructed in accordance with aspects described for hard horn antenna 100 offer additional benefits. For example, utilizing a metamaterial as a dielectric layer allows a horn antenna 100 to be constructed which has a fluid core. Consequently, a solid core such as used in horn antenna 200 may be eliminated. Additionally, any losses and electrostatic discharge (ESD) due to such solid core may be eliminated.

Figure 3:
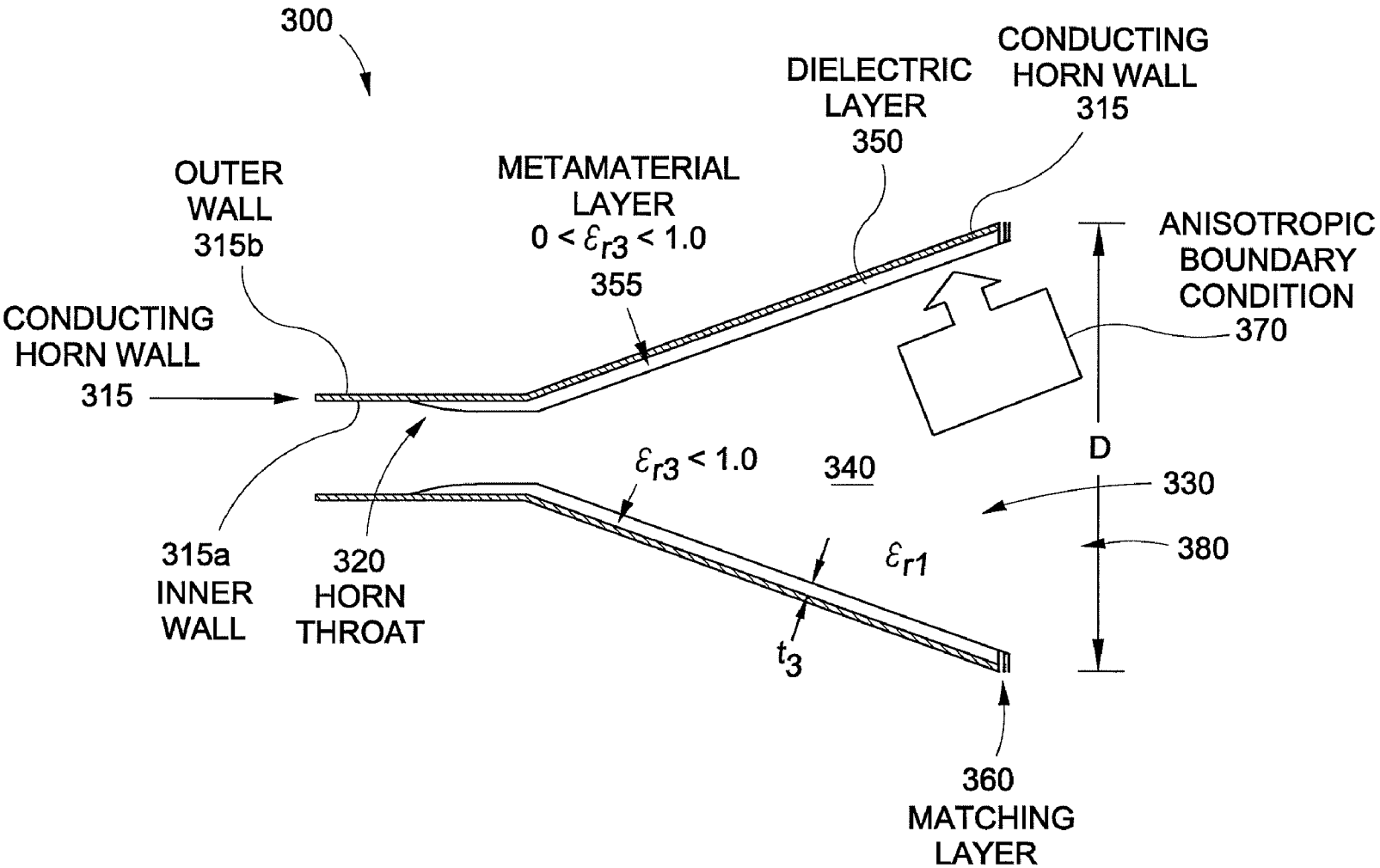
FIG. 3 illustrates an exemplary horn antenna in accordance with one aspect of the present invention.

Referring now to FIG. 3, an exemplary horn antenna 300 in accordance with one aspect of the present invention is shown. As shown in FIG. 3, horn antenna 300 represents a soft horn and includes a conducting horn 310 having a conducting horn wall 315. Conducting horn wall 315 may include an inner wall 315*a* and an outer wall 315*b*. Conducting horn wall 315 extends outwardly from a horn throat 320 to define an aperture 380 having a diameter D. In one aspect, conducting horn 310 has anisotropic wall impedance according to equations (1) and (2) and shown by anisotropic boundary condition 370.

The space within horn 310 may be at least partially filled with a dielectric core 330. In one aspect, dielectric core 330 includes an inner core portion 340 which comprises a fluid such as an inert gas, air, or the like. In some aspects, inner core portion 340 comprises a vacuum.

In one aspect, dielectric core 330 may be separated from horn wall 315 by a first dielectric layer 350 and may help correctly position core 330. First dielectric layer 350 comprises a metamaterial and lines a portion or all of horn wall 315. In some aspects, first dielectric layer 350 comprises a metamaterial layer 355. According to one aspect of the present invention, metamaterial layer 355 comprises a metamaterial having a relative dielectric constant of greater than zero and less than one.

In some aspects, first dielectric layer 350 has a lower relative dielectric constant than inner core portion 340 ($\in_{r3}<\in_{r1}$). It should be appreciated that by using a metamaterial having a relative dielectric constant of greater than zero and less than one in first dielectric layer 350, inner core portion 340 may comprise a fluid such as air.

In one aspect, first dielectric layer 350 may have a generally uniform thickness $t_3$ and extends from about throat 320 to aperture 380. Additionally, $t_3$ may be constructed in accordance with thicknesses used generally for conducting horns.

Horn throat 320 may be matched for low return loss and for converting the incident field into a field with required cross-sectional distribution over aperture 380. Furthermore, conducting horn 310 may also include one or more matching layers 360 between first dielectric layer 350 and free space in aperture 380.

Figure 4:
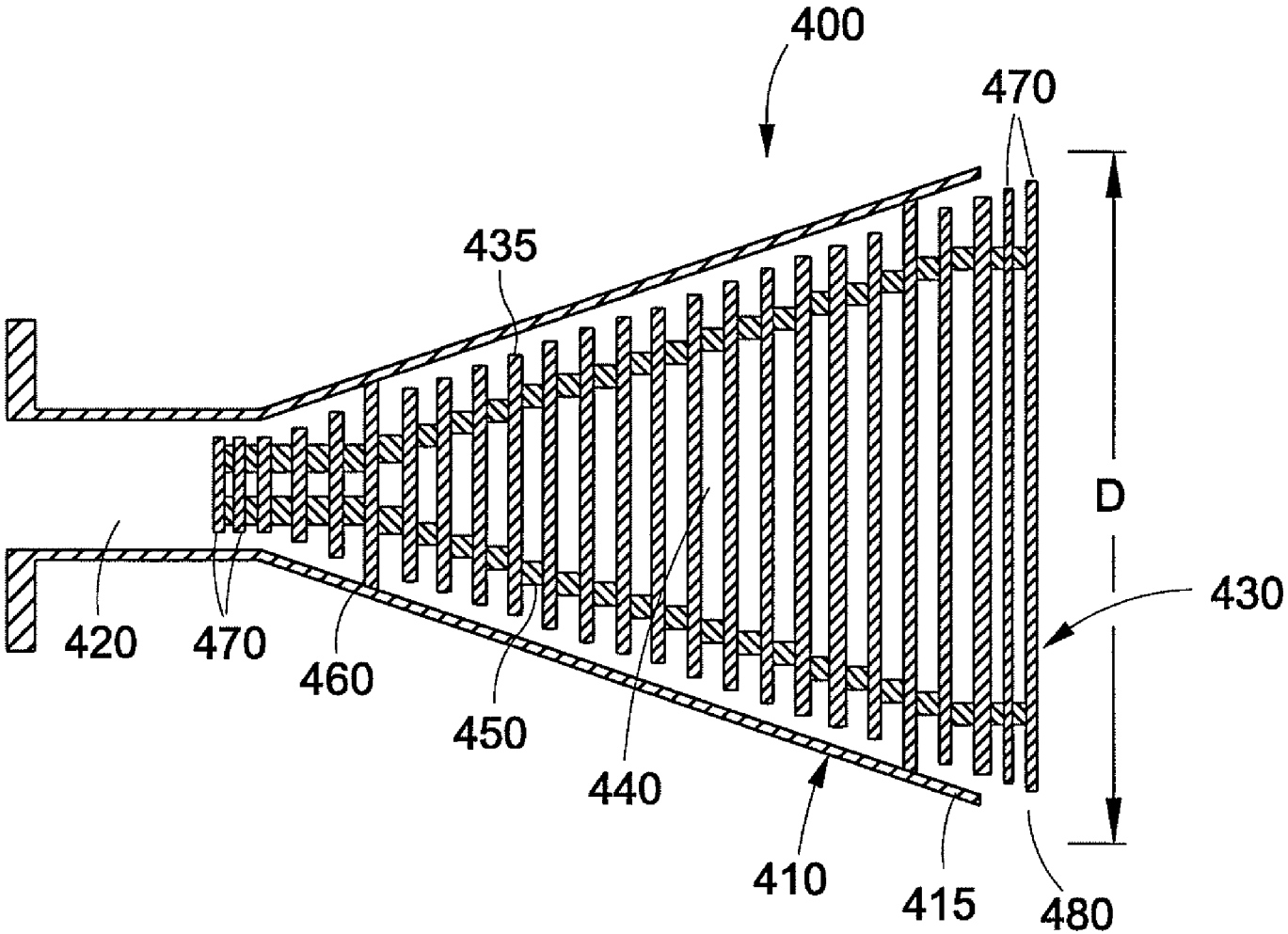
FIG. 4 illustrates yet another exemplary horn antenna.

Referring now to FIG. 4, an exemplary soft horn antenna 400 is illustrated. Horn antenna 400 includes a conducting horn 410 having a conducting horn wall 415. Conducting horn wall 415 extends outwardly from a horn throat 420 to define an aperture 480 having a diameter D.

The space within horn 410 may be at least partially filled with a dielectric core 430. In one aspect, dielectric core 430 includes an inner core portion 440 which comprises a plurality of solid dielectric discs 435. Dielectric disks 435 may be constructed from foam, honeycomb, or the like. In one aspect, dielectric disks 435 may be separated from each other by spacers 450. In one aspect, the plurality of solid dielectric disks 435 may be positioned within inner core portion 440 by spacers 460 abutting conducting horn wall 415. Additionally, horn 410 may include one or more matching layers 470 between dielectric and free space in aperture 480. In one aspect, matching layer 470 comprises two dielectric disks 435.

Horn antennas constructed in accordance with aspects described for soft horn antenna 300 offer additional benefits over horn antenna 400. For example, utilizing a metamaterial as a dielectric layer allows a horn antenna to be constructed which has a fluid core. Consequently, a core comprising solid dielectric disks such as used in horn antenna 400 may be eliminated. Additionally, any losses and electrostatic discharge (ESD) due to such solid dielectric disks may be eliminated.

Figure 5:
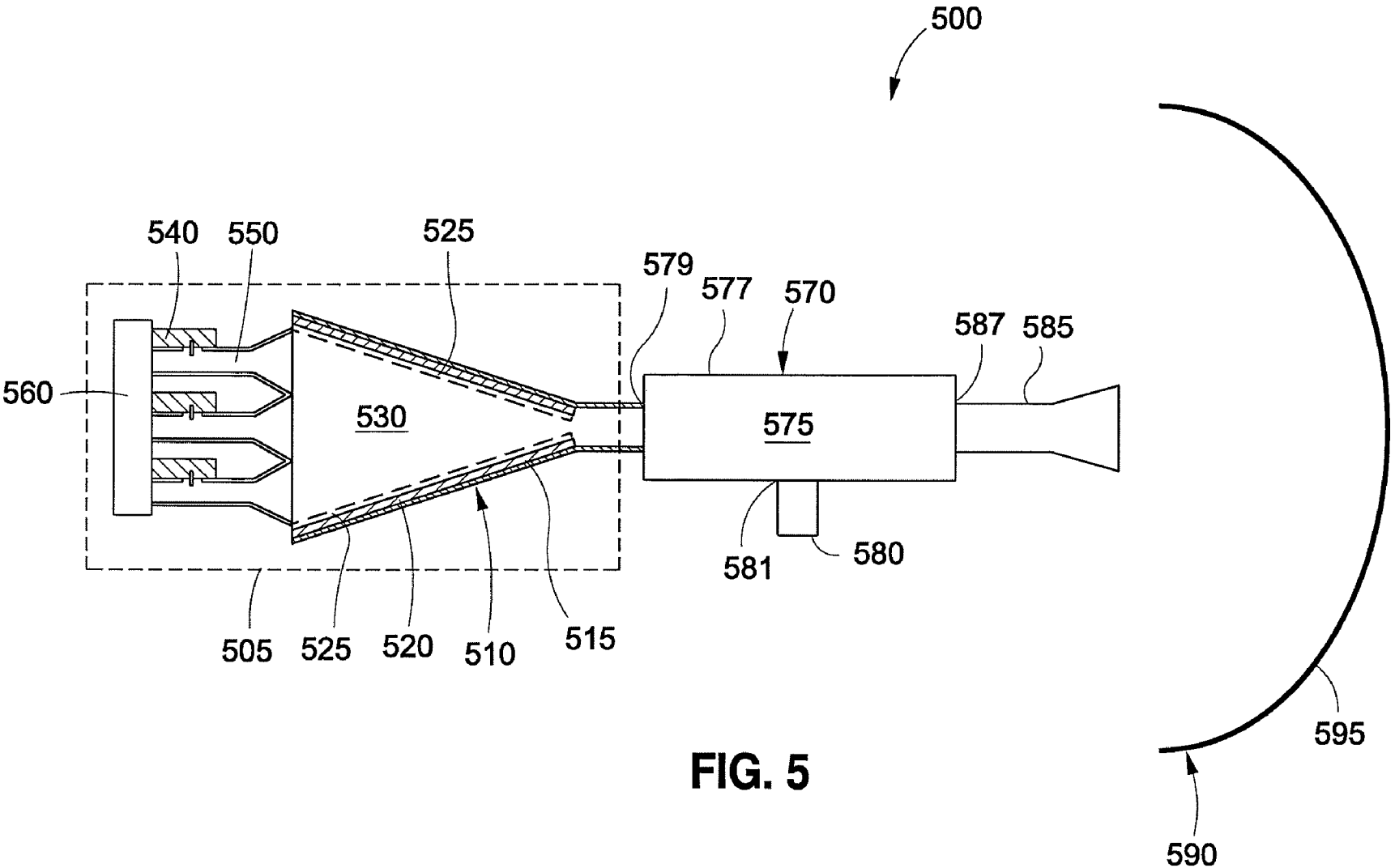
FIG. 5 illustrates an exemplary power combiner assembly in accordance with one aspect of the present invention.

Referring now to FIG. 5, an exemplary power combiner assembly 500 in accordance with one aspect of the present invention is shown. Power combiner assembly 500 includes a power combiner system 505. In one aspect, power combiner assembly 500 also includes a multiplexer 570 and a reflector 590 such as a reflective dish 595. In one aspect, reflector 590 may include one or more sub-reflectors.

Power combiner system 505 includes a horn antenna 510 in communication with a plurality of power amplifiers 540. In one aspect, power amplifiers 540 comprise solid state power amplifiers (SSPA). In some aspects, power amplifiers 540 may be in communication with a heat dissipation device 560 such as a heat spreader. In one aspect, all of power amplifiers 540 operate at the same operating point, thereby providing uniform power distribution over the aperture of horn antenna 510. For example, power amplifiers 540 may output signals operating in the radio frequency (RF) range. In one aspect, the RF range includes frequencies from approximately 3 Hz to 300 GHz. In another aspect, the RF range includes frequencies from approximately 1 GHz to 100 GHz. These are exemplary ranges, and the subject technology is not limited to these exemplary ranges.

The plurality of power amplifiers 540 may provide power to horn antenna 510 via known transmission means such as a waveguide or antenna element 550. In one aspect, an open-ended waveguide may be associated with each of the plurality of power amplifiers 540. In one aspect, a microstrip antenna element may be associated with each of the plurality of power amplifiers 540.

In one aspect, horn antenna 510 includes a conducting horn wall 515, an inner core portion 530, and a first dielectric layer 520 disposed in between horn wall 515 and inner core portion 530. In one aspect, inner core portion 530 comprises a fluid such as an inert gas or air. In one aspect, first dielectric layer 520 comprises a metamaterial having a relative dielectric constant of greater than zero and less than one. In one aspect, horn antenna 510 may also include a second dielectric layer 525 disposed between first dielectric layer 520 and inner core portion 530. In this example, first dielectric layer 520 directly abuts conducting horn wall 515, second dielectric layer 525 directly abuts first dielectric layer 520, and second dielectric layer 525 also abuts inner core portion 530.

In one aspect, multiplexer 570 comprises a diplexer 575. Diplexer 575 includes an enclosure 577 having a common port 587, a transmit input port 579 and a receive output port 581. In some aspects, diplexer 575 further includes a plurality of filters for filtering transmitted and received signals. One of ordinary skill in the art would be familiar with the operation of a diplexer 575, so further discussion is not necessary. In one aspect, the main port 579 may be configured to receive power signals from horn antenna 520.

In one aspect, common port 587 may be coupled to a feed horn 585 and may be configured to direct and guide the RF signal to reflector 590. In one aspect, power combiner assembly 500 may be mounted to a reflective dish 595 for receiving and/or transmitting the RF signal. As an example, reflective dish 595 may comprise a satellite dish.

A benefit associated with power combiner assembly 500 is that power combiner assembly 500 allows all of power amplifiers 540 to be driven at the same operating point, thereby enabling maximum spatial power combining efficiency. Additionally, power combiner assembly 500 offers simultaneous linear or circular polarization.

Figure 6:
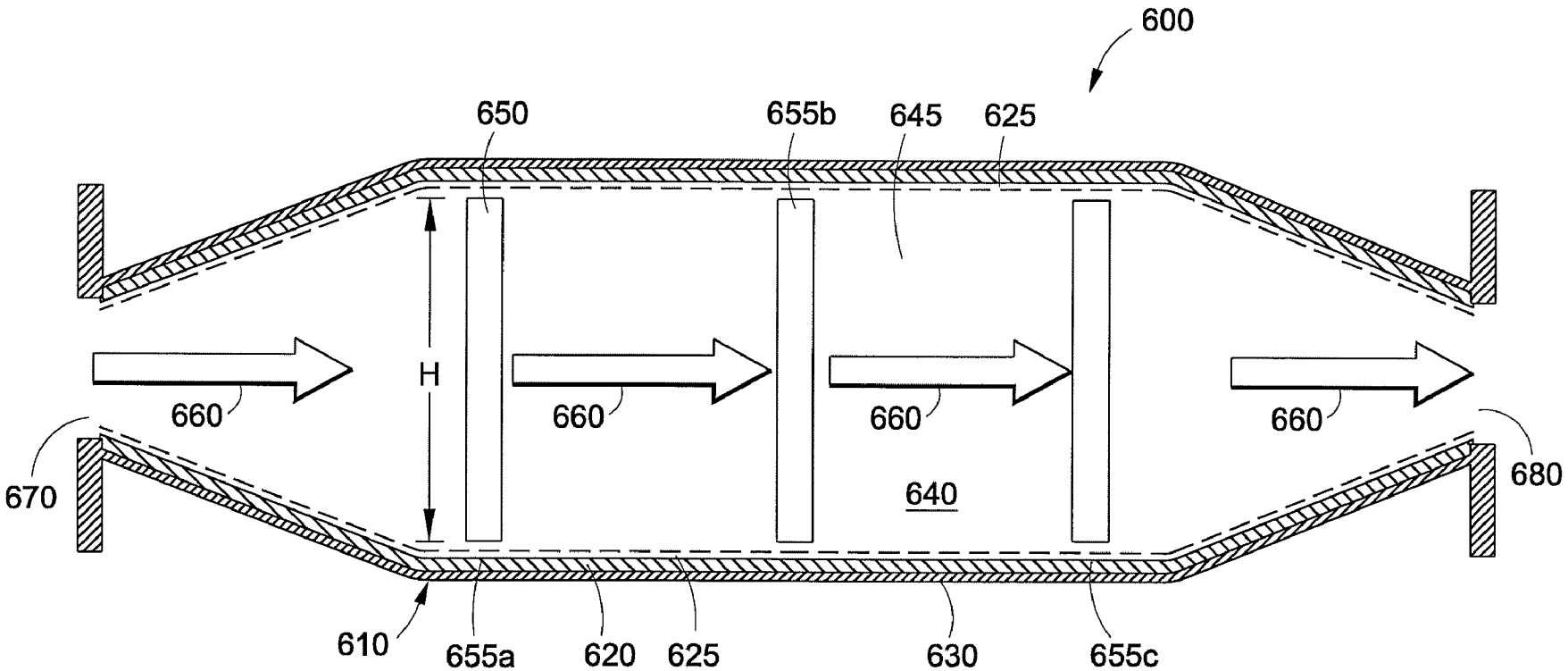
FIG. 6 illustrates an exemplary waveguide assembly in accordance with one aspect of the present invention.

Referring now to FIG. 6, an exemplary waveguide 600 in accordance with one aspect of the present invention is shown. Waveguide 600 includes an outer surface 610, an inner surface 630, and an inner cavity 640. Inner cavity 640 is at least partially defined by outer surface 610.

Waveguide 600 further includes a first aperture 670 and a second aperture 680 located at opposite ends of waveguide 600 with inner cavity 640 located therein between the apertures 670, 680. It should be understood that first aperture 670 may be configured to receive RF signals into waveguide 600 and that second aperture 680 may be configured to transmit RF signals out of waveguide 600.

In one aspect, the portion of waveguide 600 surrounding first aperture 670 may be tapered so that inner cavity 640 decreases in size as it approaches the first aperture 670. This tapering of waveguide 600 enables first aperture 670 to operate as a power divider because the power of a signal received by aperture 670 may be spread out over height H of inner cavity 640. In one aspect, the portion of waveguide 600 surrounding second aperture 680 may be tapered so that inner cavity 640 decreases in size as it approaches second aperture 680. This tapering of waveguide 600 enables second aperture 680 to operate as a power combiner because the power of the signal that propagates through inner cavity 640 may be condensed when it exits through second aperture 680.

In one aspect, a first dielectric layer 620 may be disposed between inner surface 630 and inner cavity 640. In one aspect, first dielectric layer 620 comprises a metamaterial having a relative dielectric constant of greater than zero and less than one. In one aspect, a second dielectric layer 625 may be disposed between first dielectric layer 620 and inner cavity 640. Second dielectric layer 625 may directly abut first dielectric layer 620 and inner cavity 640.

In one aspect, inner cavity 640 includes a fluid portion 645 such as gas or air and a solid portion 650. In one aspect, solid portion 650 comprises a plurality of power amplifiers 655. In one aspect, the plurality of power amplifiers 655 may be arranged parallel to each other. In one aspect, the plurality of power amplifiers 655 may be arranged so that they are substantially perpendicular to inner surface 630.

Outer surface 610, inner surface 630, first aperture 670, and second aperture 680 may be circular, elliptical, rectangular, hexagonal, square, or some other configuration all within the scope of the present invention. In this example, each of inner surface 630 and outer surface 610 is circular, and is one continuous wall completely surrounding inner cavity 640 (but not covering two end apertures 670 and 680. Each of inner surface 630 and outer surface 610 has a first tapered region, a straight region, and a second taper region. The first tapered region is disposed between first aperture 670 and the straight region, and the second tapered region is disposed between the straight region and second aperture 680. Each of inner surface 630 and outer surface 610 has a diameter that is greater in the straight region than its respective diameter at first aperture 670 or at second aperture 680. Each of inner surface 630 and outer surface 610 extends along the entire length of horn antenna 600.

In one aspect, first dielectric layer 620 directly abuts inner surface 630, a second dielectric layer (not shown) may also directly abut first dielectric layer 620, and inner cavity 640 may directly abut first dielectric layer 620 (if no second dielectric layer is present) or directly abut the second dielectric layer, if present. In this example, first dielectric layer 620 lines substantially the entire length of inner surface 630 (e.g., first dielectric layer 620 lines the entire length of horn antenna 600, or first dielectric layer 160 lines more than 60%, 70%, 80%, or 90% of the length of horn antenna 600). The second dielectric layer, if present, may also line substantially the entire length of inner surface 630. The subject technology, however, is not limited to these examples.

In one aspect, the plurality of power amplifiers 655 may be arranged in an array such that there are amplification stages. As shown in FIG. 6, there are three such amplification stages. For example, in one aspect an RF signal 660 enters waveguide 600 through aperture 670 and illuminates power amplifier 655*a*. Power amplifier 655*a* amplifies signal 660 a first time. Thereafter, signal 660 illuminates power amplifier 655*b*, which in turn amplifies the signal 660 a second time. Thereafter, signal 660 illuminates power amplifier 655*c*, which in turn amplifies the signal 660 a third time before it exits waveguide 600 through aperture 680.

A benefit realized by waveguide 600 is that RF signal may be amplified by utilizing amplification stages. Additionally, because the design of waveguide 600 may be relatively simple, any number of amplification stages may be easily added.

Figure 8:
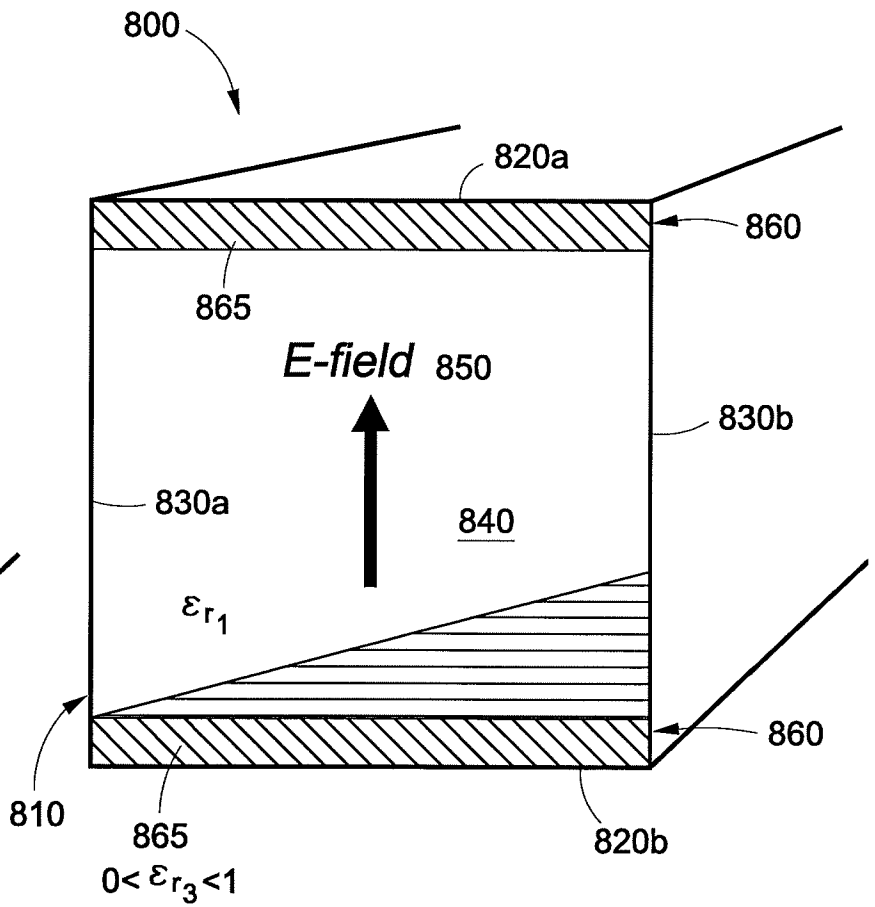
FIG. 8 illustrates an exemplary horn antenna in accordance with one aspect of the present invention.

Referring now to FIG. 8, another exemplary horn antenna 800 in accordance with one aspect of the present invention is shown. As shown in FIG. 8, horn antenna 800 represents a soft horn and includes a rectangular conducting horn 810 having four conducting horn walls 820*a*, 820*b*, 830*a* and 830*b*. Conducting horn walls 820*a* and 820*b* are parallel to each other, and conducting horn walls 830*a* and 830*b* are parallel to each other. Conducting horn walls 820*a* and 820*b* are perpendicular to conducting horn walls 830*a* and 830*b*. Conducting horn walls 820*a*, 820*b*, 830*a* and 830*b* include inner wall and outer wall portions, with the inner walls being proximate to a dielectric core 840 (described below).

The space within horn 810 may be at least partially filled with dielectric core 840. In one aspect, dielectric core 840 comprises a fluid such as an inert gas, air, or the like. In some aspects, dielectric core 840 comprises a vacuum.

When used as a waveguide, an electric field 850 results within horn 810 and is polarized parallel to conducting horn walls 830*a* and 830*b* and perpendicular to conducting horn walls 820*a* and 820*b*. Consequently, horn walls 820*a* and 820*b* may be referred to as E-plane walls. According to one aspect, dielectric core 840 may be separated from horn walls 820*a* and 820*b* by a dielectric layer 860.

Dielectric layer 860 comprises a metamaterial and lines a portion or all of horn walls 820*a* and 820*b*. In some aspects, dielectric layer 860 is a metamaterial layer 865 comprising a metamaterial having a relative dielectric constant of greater than zero and less than one. This is to achieve a tapered electric field distribution in the E-plane similar to the H-plane.

In some aspects, dielectric layer 860 has a lower relative dielectric constant than dielectric core 840 ($\in_{r3}<\in_{r1}$). It should be appreciated that by using a metamaterial having a relative dielectric constant of greater than zero and less than one in dielectric layer 860, dielectric core 840 may comprise a fluid such as air.

In one aspect, dielectric layer 860 may have a generally uniform thickness. Additionally, dielectric layer 860 may be constructed in accordance with thicknesses used generally for conducting horns.

It should be noted that horn antenna 800 may include a matching layer similar to matching layer 170 of FIG. 1, and that a dielectric layer comprising metamaterial may line a portion of a horn wall(s) in a configuration different than the configuration shown in FIG. 8.

Figure 9:
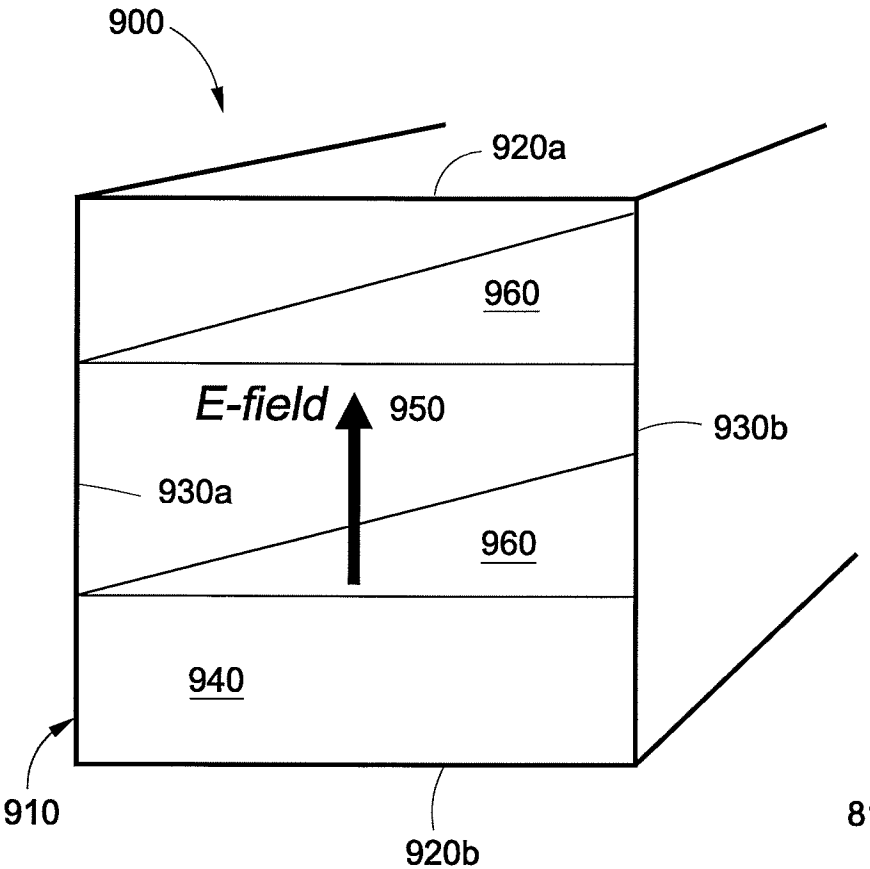
FIG. 9 illustrates yet another exemplary horn antenna.

Referring now to FIG. 9, an exemplary horn antenna 900 is illustrated with a similar electric field distribution as the horn antenna in FIG. 8. Horn antenna 900 includes a rectangular conducting horn 910 having four conducting horn walls 920*a*, 920*b*, 930*a* and 930*b*. Conducting horn walls 920*a* and 920*b* are parallel to each other and conducting horn walls 930*a* and 930*b* are parallel to each other. Conducting horn walls 920*a* and 920*b* are perpendicular to conducting horn walls 930*a* and 930*b*.

The space within horn 910 may be at least partially filled with a dielectric core 940. In one aspect, dielectric core 940 comprises a fluid such as an inert gas, air, or the like. In some aspects, dielectric core 940 comprises a vacuum.

Also within horn 910 are a plurality of trifurcations or veins 960. Trifurcations 960 are positioned in parallel with conducting horn walls 920*a* and 920*b*, so that when horn 910 is used as a waveguide, the resulting electric field 950 is perpendicular to trifurcations 960. As shown in FIG. 9, two trifurcations 960 are positioned to cause horn 910 to be divided into three roughly equal sections.

Horn antennas constructed in accordance with aspects described for soft horn antenna 800 offer additional benefits over horn antenna 900. For example, utilizing a metamaterial as a dielectric layer allows a horn antenna to be constructed which has a lower cost. And, while both horn antennas 800 and 900 create an E-plane amplitude taper, horn antenna 800 offers higher overall antenna efficiency (due to lower horn sidelobes).

Referring to FIGS. 1-9, in one aspect, the relative dielectric constant of a dielectric layer is constant within the dielectric layer, the thickness of a dielectric layer is constant within the dielectric layer, and the relative permittivity of a dielectric layer is constant within the dielectric layer. In another aspect, the relative dielectric constant of one, several or all of the dielectric layers may vary with distance (e.g., continuously, linearly or in some other manner) in one, some or all directions (e.g., in a direction normal to a horn wall and/or along the horn wall. In this example, the relative dielectric constants do not vary in steps between different dielectric layers. In yet another aspect, the thickness of one, several or all of the dielectric layers may vary (e.g., continuously, linearly or in some other manner) in one, some or all directions (e.g., in a direction normal to a horn wall and/or along the horn wall. In yet another aspect, the relative permittivity of one, several or all of the dielectric layers may vary (e.g., continuously, linearly or in some other manner) in one, some or all directions (e.g., in a direction normal to a horn wall and/or along the horn wall. In this paragraph, a dielectric layer may refer to any of the dielectric layers described above (e.g., 160, 165, 150, 155, 250, 350, 355, 520, 525, 620, 625, 730, 740).

The description of the invention is provided to enable any person skilled in the art to practice the various arrangements described herein. While the present invention has been particularly described with reference to the various figures and configurations, it should be understood that these are for illustration purposes only and should not be taken as limiting the scope of the invention. There may be many other ways to implement the invention. Various functions and elements described herein may be partitioned differently from those shown without departing from the scope of the invention. Various modifications to these configurations will be readily apparent to those skilled in the art, and generic principles defined herein may be applied to other configurations. Thus, many changes and modifications may be made to the invention, by one having ordinary skill in the art, without departing from the scope of the invention.

Unless specifically stated otherwise, the term "some" refers to one or more. A reference to an element in the singular is not intended to mean "one and only one" unless specifically stated, but rather "one or more."

Terms such as "top," "bottom," "into," "out of" and the like as used in this disclosure should be understood as referring to an arbitrary frame of reference, rather than to the ordinary gravitational frame of reference. Thus, for example, a top surface and a bottom surface may extend upwardly, downwardly, diagonally, or horizontally in a gravitational frame of reference.

All structural and functional equivalents to the elements of the various configurations described throughout this disclosure that are known or later come to be known to those of ordinary skill in the art are expressly incorporated herein by reference and intended to be encompassed by the invention. Moreover, nothing disclosed herein is intended to be dedicated to the public regardless of whether such disclosure is explicitly recited in the above description. No claim element is to be construed under the provisions of 35 U.S.C. §112, sixth paragraph, unless the element is expressly recited using the phrase "means for" or, in the case of a method claim, the element is recited using the phrase "step for."

It is understood that the specific order or hierarchy of steps in the processes disclosed is an illustration of exemplary approaches. Based upon design preferences, it is understood that the specific order or hierarchy of steps in the processes may be rearranged. Any accompanying method claims present elements of the various steps in a sample order, which may or may not occur sequentially, and are not meant to be limited to the specific order or hierarchy presented. Furthermore, some of the steps may be performed simultaneously.

What is claimed is:

1. A horn antenna comprising:

a conducting horn having an inner wall; and a first dielectric layer lining the inner wall of the conducting horn, wherein the first dielectric layer comprises a metamaterial having a relative dielectric constant of greater than 0 and less than 1.

2. The horn antenna of claim 1, further comprising:

a dielectric core abutting at least a portion of the first dielectric layer, the dielectric core comprising a fluid.

3. The horn antenna of claim 2, wherein the dielectric core comprises a higher relative dielectric constant than the first dielectric layer.

4. The horn antenna of claim 1, further comprising:

a second dielectric layer disposed over at least a portion of the first dielectric layer.

5. The horn antenna of claim 4, further comprising:

a dielectric core abutting at least a portion of the second dielectric layer, the dielectric core comprising a fluid.

6. The horn antenna of claim 5, wherein the second dielectric layer comprises a higher relative dielectric constant than the dielectric core, and the dielectric core comprises a higher relative dielectric constant than the first dielectric layer.

7. The horn antenna of claim 4, wherein the relative dielectric constant of the first dielectric layer varies with distance in one or more directions, and/or a relative dielectric constant of the second dielectric layer varies with distance in one or more directions.

8. The horn antenna of claim 4, wherein a thickness of the first dielectric layer varies with distance in one or more directions, and/or a thickness of the second dielectric layer varies with distance in one or more directions.

9. A power combiner assembly comprising the horn antenna of claim 4, the power combiner further comprising:

a plurality of power amplifiers, wherein the plurality of power amplifiers are configured to provide power to the conducting horn and wherein the conducting horn is configured to combine the power from the plurality of power amplifiers into a single power transmission.

10. A reflector antenna comprising the power combiner assembly of claim 9, the reflector antenna further comprising:

a reflective dish, wherein the conducting horn is configured to direct the single power transmission towards the reflective dish.

11. The horn antenna of claim 1, wherein the conducting horn comprises a plurality of inner walls, and wherein a subset of the plurality of inner walls comprises the inner wall.

12. The horn antenna of claim 11, wherein the plurality of inner walls includes four walls, and the subset comprising the inner wall includes two walls.

13. The horn antenna of claim 12, wherein the subset of the plurality of inner walls are parallel.

14. The horn antenna of claim 1, wherein the horn antenna is rectangular, circular, hexagonal or elliptical.

15. The horn antenna of claim 1, wherein the first dielectric layer lines a portion of the inner wall.

16. The horn antenna of claim 1, wherein the first dielectric layer lines substantially the entire length of the inner wall.

17. The horn antenna of claim 1, wherein the relative dielectric constant of the first dielectric layer varies with distance in one or more directions.

18. The horn antenna of claim 1, wherein a thickness of the first dielectric layer varies with distance in one or more directions.

19. A waveguide comprising:

an outer surface defining a waveguide cavity;

an inner surface positioned within the waveguide cavity; and a first dielectric layer lining the inner surface of the waveguide cavity, wherein the first dielectric layer comprises a metamaterial having a relative dielectric constant of greater than 0 and less than 1.

20. The waveguide of claim 19, wherein the inner surface of the waveguide comprises a second dielectric layer, the second dielectric layer having a higher relative dielectric constant than the first dielectric layer.

21. The waveguide of claim 19, wherein the waveguide cavity comprises a fluid.

22. The waveguide of claim 19, wherein the inner surface comprises a plurality of inner walls, and wherein a subset of the plurality of inner walls comprises the inner surface.

23. The waveguide of claim 22, wherein the plurality of inner walls includes four walls, and the subset comprising the inner surface includes two walls.

24. The waveguide of claim 19, wherein the first dielectric layer lines a portion of the inner surface.

25. The waveguide of claim 19, wherein the first dielectric layer lines substantially the entire length of the inner surface.

* * * * *